US008963785B2

(12) United States Patent
Dong et al.

(10) Patent No.: US 8,963,785 B2
(45) Date of Patent: Feb. 24, 2015

(54) ANTENNA STRUCTURE FOR USING WITH A METAL FRAME OF A MOBILE PHONE

(71) Applicant: Auden Techno.Corp, Pa-Te, Taoyuan Hsien (TW)

(72) Inventors: Chao Dong, Pa-Te (TW); Bo Zhou, Pa-Te (TW); Chia-Lun Tang, Pa-Te (TW)

(73) Assignee: Auden Techno. Corp., Pa-Te, Taoyuan Hsien (TW)

( * ) Notice: Subject to any disclaimer, the term of this patent is extended or adjusted under 35 U.S.C. 154(b) by 284 days.

(21) Appl. No.: 13/728,587

(22) Filed: Dec. 27, 2012

(65) Prior Publication Data

US 2014/0184449 A1 Jul. 3, 2014

(51) Int. Cl.
*H01Q 1/24* (2006.01)
*H01Q 13/10* (2006.01)
*H01Q 21/30* (2006.01)

(52) U.S. Cl.
CPC ..... *H01Q 13/106* (2013.01); *H01Q 21/30* (2013.01)
USPC ..... 343/702; 343/770; 343/767

(58) Field of Classification Search
CPC ..... H01Q 13/10; H01Q 13/106; H01Q 5/00; H01Q 5/001; H01Q 5/0003
USPC ..... 343/702, 767, 770, 872
See application file for complete search history.

(56) References Cited

U.S. PATENT DOCUMENTS

| | | | | |
|---|---|---|---|---|
| 8,648,752 | B2 * | 2/2014 | Ramachandran et al. | 343/702 |
| 8,665,164 | B2 * | 3/2014 | Hill et al. | 343/767 |
| 8,779,999 | B2 * | 7/2014 | Gummalla | 343/767 |
| 2012/0299785 | A1 * | 11/2012 | Bevelacqua | 343/702 |
| 2013/0194138 | A1 * | 8/2013 | Hammond | 343/702 |
| 2014/0118204 | A1 * | 5/2014 | Gavilan et al. | 343/745 |

FOREIGN PATENT DOCUMENTS

CN 202282452 U 6/2012

* cited by examiner

*Primary Examiner* — Hoang V Nguyen
(74) *Attorney, Agent, or Firm* — Muncy, Geissler, Olds & Lowe, P.C.

(57) ABSTRACT

An antenna structure includes a carrier body, a circuit board, a metal coupling sheet, a first grounding part, a second grounding part, and a metal frame. A first slot and a second slot are between the metal frame and the carrier body after the parts mentioned above are assembled. The metal coupling sheet, the first grounding part, and the first slot form a first communication path. The first communication path forms a low-frequency resonance and a high-frequency resonance as well, so that the antenna structure is applied to a four bands GSM850/900/1800/1900. The metal coupling sheet, the second grounding part, and the second slot form a second communication path. The second communication path forms the WCDMA2100 resonance, so that the antenna structure is applied to a five bands 850/900/1800/1900/2100.

17 Claims, 5 Drawing Sheets

ANTENNA STRUCTURE FOR USING WITH A METAL FRAME OF A MOBILE PHONE

BACKGROUND OF THE INVENTION

1. Field of the Invention

The present invention relates to an antenna structure, and especially relates to an antenna structure for using with a metal frame of a mobile phone.

2. Description of the Related Art

The mobile phone is rigid and stylish because of the metal frame. Therefore, the metal frames are used widely for the mobile phones. However, the metal frame effects the radiation of the mobile phone very much. The related art antenna structure of the mobile phone is difficult to avoid the influence of the metal frame.

In order to avoid the influence of the metal frame, the area (near the antenna structure) of the metal frame of the mobile phone will be removed or reduced (replaced by the plastics). Or the metal frame is divided into several parts, and then some parts of the metal frame are used as the antenna structure. Besides, the planar slot antenna with micro strip line feeding is used to avoid the influence of the metal frame as well (as shown in China patent application number CN201120421743.8).

The methods mentioned above have following disadvantages.

1. The mobile phone is not stylish and the volume of the antenna structure is larger if the metal parts near the antenna structure are replaced by the plastics.

2. There are slots between some parts of the metal frame which are used as the antenna structure. The performance of the antenna structure is bad (or changed) if user's hand (or other conductors) holds (or touches) the slots.

3. There are slots on the circuit board if the planar slot antenna with micro strip line feeding is applied. Therefore, large area of the circuit board will be occupied and be used by the slots.

SUMMARY OF THE INVENTION

In order to solve the above-mentioned problems, an object of the present invention is to provide an antenna structure. The metal frame of the mobile phone is not divided into several parts for being used as the antenna structure. The metal parts near the antenna structure are not replaced by the plastics. Therefore, the mobile phone is still stylish. The performance of the antenna structure is not changed if user's hand (or other conductors) holds (or touches) the mobile phone because there is no slot on the metal frame. Besides, no area of the circuit board will be occupied and be used by the slots on the circuit board because the planar slot antenna with micro strip line feeding is not applied.

In order to achieve the object of the present invention mentioned above, the present invention is to provide an antenna structure for using with a metal frame of a mobile phone. The antenna structure includes a carrier body, a circuit board, a metal coupling sheet, a first grounding part, a second grounding part, and a metal frame. The carrier body includes a top side, a bottom side, a right side, and a left side. The right side is connected to the top side and the bottom side. The left side is connected to the top side and the bottom side. The circuit board is assembled with the carrier body. The metal coupling sheet is electrically connected to the circuit board and is arranged at the bottom side of the carrier body. The first grounding part is connected to the left side of the carrier body and is electrically connected to the circuit board. The second grounding part is connected to the left side of the carrier body and is below the first grounding part and is electrically connected to the circuit board. The metal frame is assembled with the carrier body and is at the top side, the bottom side, the right side, and the left side, and is electrically connected to the first grounding part and the second grounding part. A first slot is between the metal frame and the right side. A second slot is between the metal frame, below the left side, and the bottom side. The metal coupling sheet, the first grounding part, and the first slot form a first communication path. The metal coupling sheet, the second grounding part, and the second slot form a second communication path. A signal feeding network and an RF circuit are on the circuit board. The signal feeding network and the RF circuit are configured to process and control signals. The metal coupling sheet includes a coupling part in arc shape and a signal feed-in part connected to the coupling part. The coupling part and the signal feed-in part form the metal coupling sheet in T-shape. A cross-section of the coupling part is in L-shape. The coupling part includes a long segment, a short segment, and an extension segment. The extension segment is connected to one side of the long segment and one side of the short segment. The long segment and the signal feed-in part are applied to the Global System for Mobile Communications (GSM). The short segment and the signal feed-in part are applied to the Wideband Code Division Multiple Access 2100 (WCDMA2100). A distance is between the metal frame and the coupling part of the metal coupling sheet after the metal frame is assembled with the carrier body. A coupling distance between the metal coupling sheet and the metal frame are adjusted for changing an impedance of the antenna structure. The extension segment is perpendicular to the long segment and the short segment. The extension segment is configured to couple to the metal frame, so that a low-frequency bandwidth is increased. The metal coupling sheet is in L-shape if a length of the long segment is zero or a length of the short segment is zero. The first grounding part and the second grounding part are metal blocks or metal sheets. A width of the first slot is about 2 to 3 mm. A width of the second slot is about 2 to 3 mm. The first communication path forms a low-frequency resonance and a high-frequency resonance as well, so that the antenna structure is applied to the four bands GSM850/900/1800/1900. A length of the first communication path is a wavelength of the GSM. The second communication path and the second grounding part form the WCDMA2100 resonance, so that the antenna structure is applied to the five bands 850/900/1800/1900/2100. A length of the second communication path is one-fourth wavelength of the WCDMA2100.

DETAILED DESCRIPTION OF THE INVENTION

Figure 1:
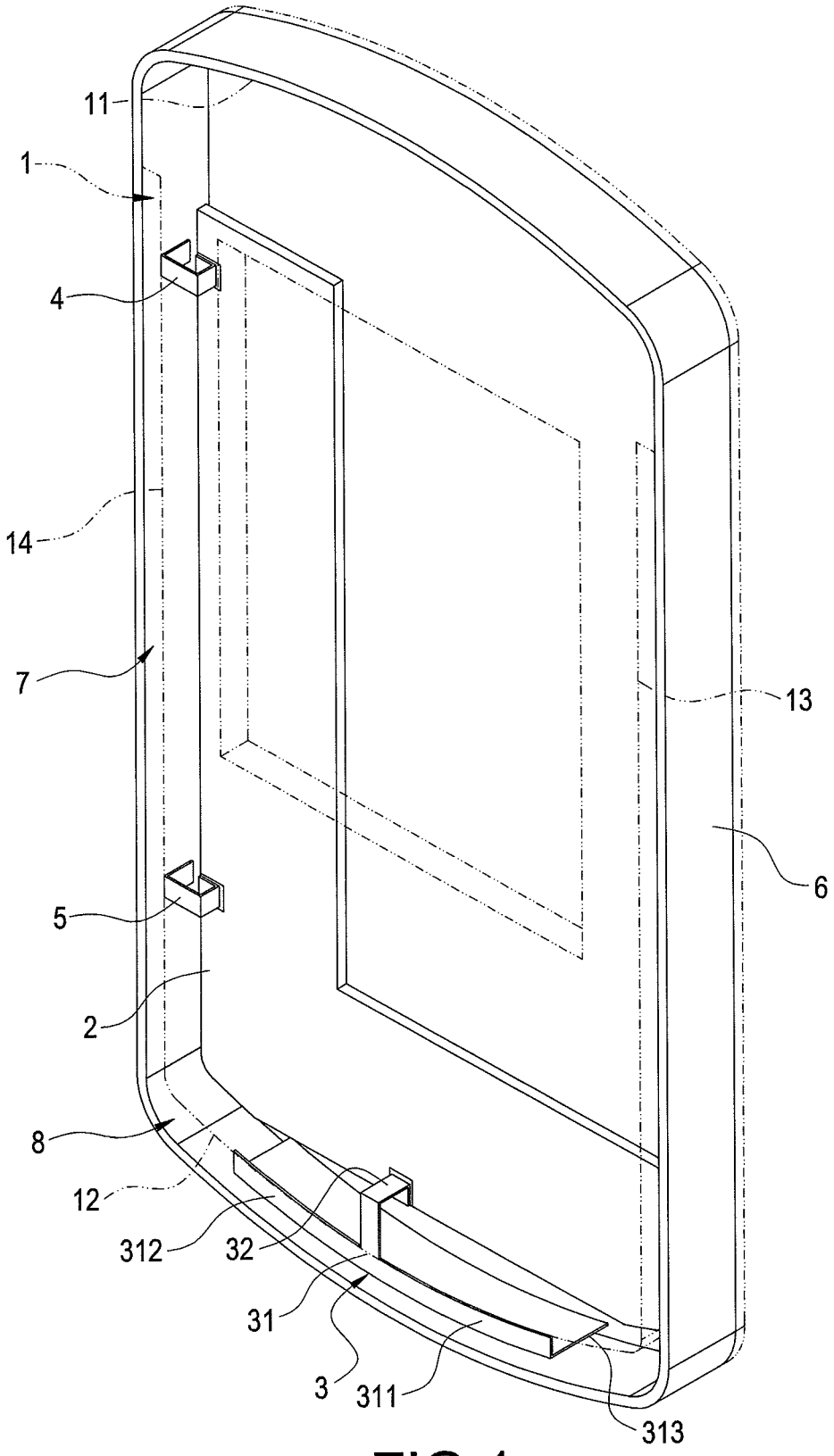
FIG. 1 shows an appearance diagram of the back side of the mobile phone of the present invention.
Figure 2:
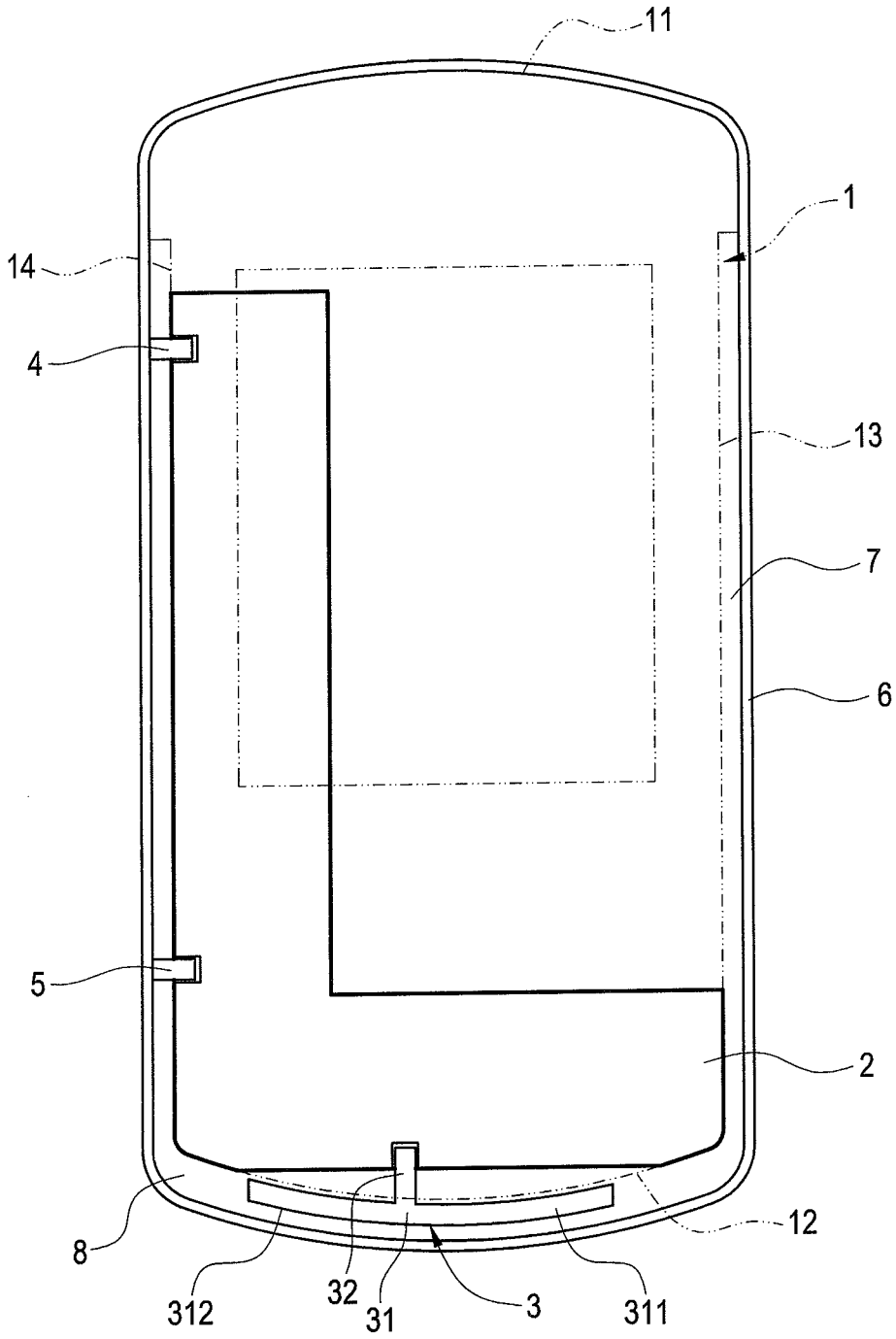
FIG. 2 shows an overlooking diagram of the back side of the mobile phone of the present invention.

FIG. 1 shows an appearance diagram of the back side of the mobile phone of the present invention. FIG. 2 shows an overlooking diagram of the back side of the mobile phone of the present invention. An antenna structure of the present invention includes a carrier body 1, a circuit board 2, a metal coupling sheet 3, a first grounding part 4, a second grounding part 5, and a metal frame 6.

The carrier body 1 includes a top side 11, a bottom side 12, a right side 12, and a left side 14. The right side 13 is connected to the top side 11 and the bottom side 12. The left side 14 is connected to the top side 11 and the bottom side 12. The carrier body 1 carries the circuit board 2 of the mobile phone and carries a battery (not shown in FIG. 1 and FIG. 2). The carrier body 1 is assembled with the metal coupling sheet 3, the first grounding part 4, the second grounding part 5, a memory card (not shown in FIG. 1 and FIG. 2), and a carrier object (not shown in FIG. 1 and FIG. 2) of the metal frame 6.

The circuit board 2 is assembled with the carrier body 1. A signal feeding network (not shown in FIG. 1 and FIG. 2) and an RF circuit (not shown in FIG. 1 and FIG. 2) are on the circuit board 2. The signal feeding network and the RF circuit are configured to process and control signals.

The metal coupling sheet 3 is electrically connected to the circuit board 2 and is arranged at the bottom side 12 of the carrier body 1. The metal coupling sheet 3 includes a coupling part 31 in arc shape and a signal feed-in part 32 connected to the coupling part 31. The coupling part 31 and the signal feed-in part 32 form the metal coupling sheet 3 in T-shape. A cross-section of the coupling part 31 is in L-shape. The coupling part 31 includes a long segment 311, a short segment 312, and an extension segment 313. The extension segment 313 is connected to one side of the long segment 311 and one side of the short segment 312. The long segment 311 and the signal feed-in part 32 are applied to the Global System for Mobile Communications (GSM). The short segment 312 and the signal feed-in part 32 are applied to the Wideband Code Division Multiple Access 2100 (WCDMA2100). The metal coupling sheet 3 is the coupling feed-in part of the antenna structure, so that a high-frequency bandwidth is increased. A coupling distance between the metal coupling sheet 3 and the metal frame 6 are adjusted for changing an impedance of the antenna structure when the metal frame 6 is assembled with the carrier body 1. The extension segment 313 is perpendicular to the long segment 311 and the short segment 312. The extension segment 313 is configured to couple to the metal frame 6, so that a low-frequency bandwidth is increased. The metal coupling sheet 3 can be folded in any shape (not just in T-shape). For example, the metal coupling sheet 3 can be folded in L-shape (the length of the long segment 311 is zero, or the length of the short segment 312 is zero).

The first grounding part 4 is connected to the left side 14 of the carrier body 1 and is electrically connected to the circuit board 2. The first grounding part 4 is a metal block or a metal sheet.

The second grounding part 5 is connected to the left side 14 of the carrier body 1 and is below the first grounding part 4 and is electrically connected to the circuit board 2. The second grounding part 5 is a metal block or a metal sheet.

The metal frame 6 is assembled with the carrier body 1 and is at the top side 11, the bottom side 12, the right side 13, and the left side 14, and is electrically connected to the first grounding part 4 and the second grounding part 5. A distance is between the metal frame 6 and the coupling part 31 of the metal coupling sheet 3. A first slot 7 is between the metal frame 6 and the right side 13 of the carrier body 1 after the metal frame 6 is assembled with the carrier body 1. A width of the first slot 7 is about 2 to 3 mm. A second slot 8 is between the metal frame 6, below the left side 14 of the carrier body 1, and the bottom side 12. A width of the second slot 8 is about 2 to 3 mm.

Figure 3:
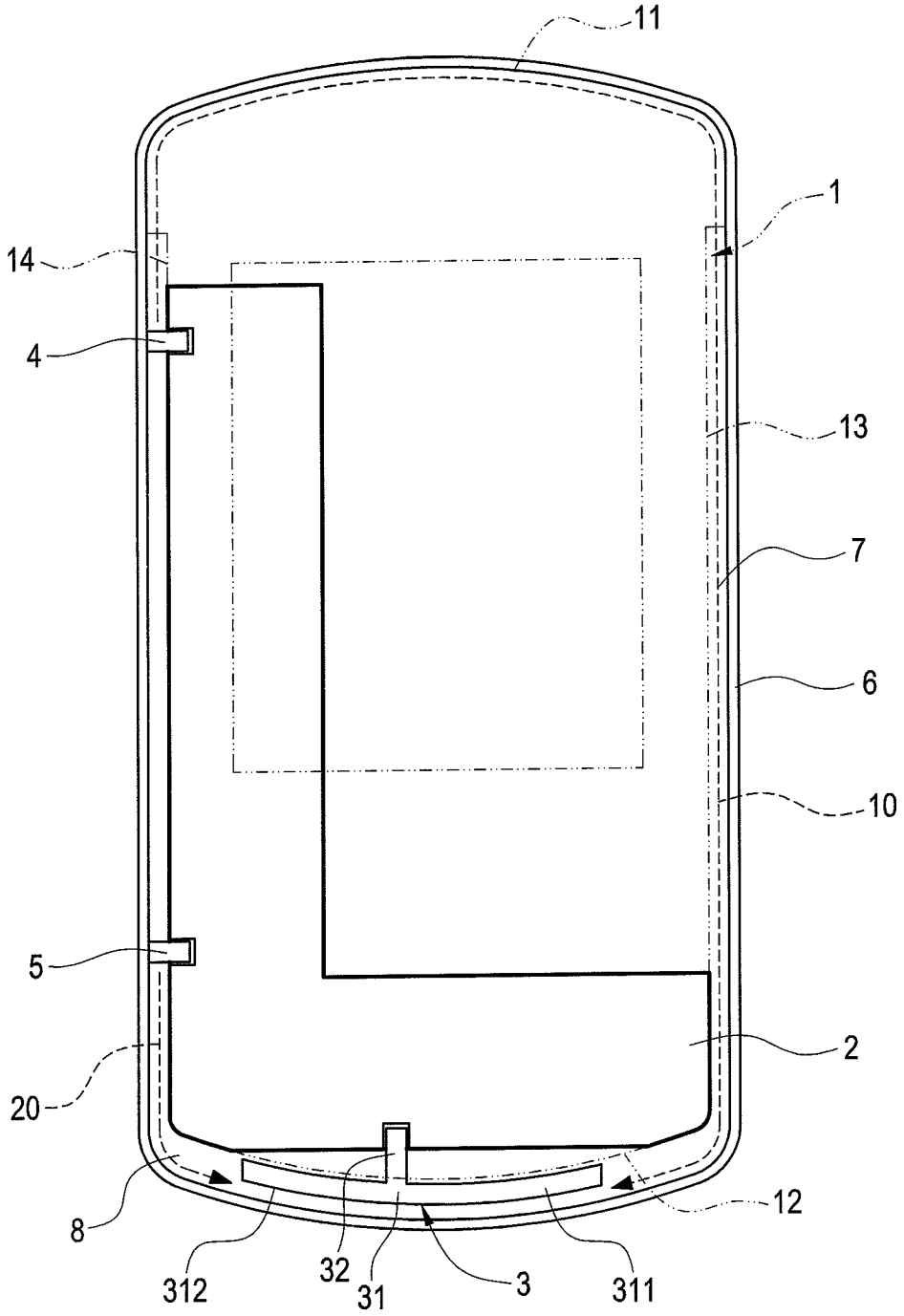
FIG. 3 shows a diagram of the first communication path and the second communication path in the back side of the mobile phone of the present invention.

FIG. 3 shows a diagram of the first communication path and the second communication path in the back side of the mobile phone of the present invention. The metal coupling sheet 3, the first grounding part 4, and the first slot 7 form a first communication path 10 (the route indicated by the dashed arrow in FIG. 3) after the carrier body 1, the circuit board 2, the metal coupling sheet 3, the first grounding part 4, the second grounding part 5, and the metal frame 6 are assembled. The first communication path 10 forms a low-frequency resonance and a high-frequency resonance as well, so that the antenna structure is applied to the four bands GSM (GSM850/900/1800/1900). The width of the first slot 7 is about 2 to 3 mm. A length of the first communication path 10 is a wavelength of the GSM850/900 (235 mm).

The metal coupling sheet 3, the second grounding part 5, and the second slot 8 form a second communication path 20 (the route indicated by the dashed arrow in FIG. 3). The second communication path 20 and the second grounding part 5 form the WCDMA2100 resonance (the frequency is 1922 MHZ to 2170 MHZ), so that the antenna structure is applied to the five bands 850/900/1800/1900/2100 (GSM/WCDMA communications). The width of the second slot 8 is about 2 to 3 mm. A length of the second communication path 20 is one-fourth wavelength of the WCDMA2100 (30 mm).

Figure 4:
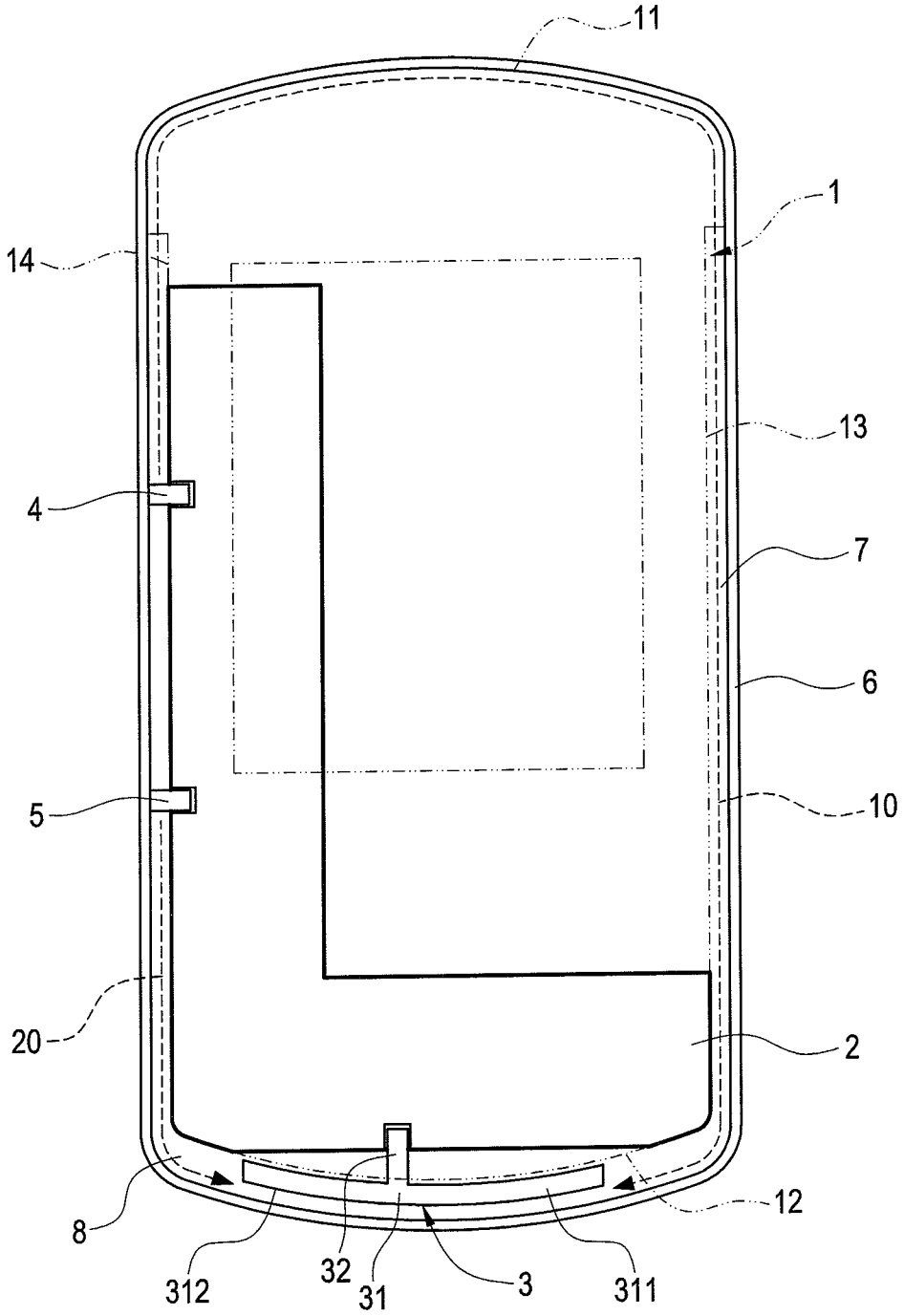
FIG. 4 shows a diagram of changing the locations of the first grounding part and the second grounding part in the back side of the mobile phone of the present invention.

FIG. 4 shows a diagram of changing the locations of the first grounding part and the second grounding part in the back side of the mobile phone of the present invention. The low-frequency characteristics and the high-frequency characteristics are adjusted if the length of the first slot 7 and the location of the first grounding part 4 are adjusted.

Similarly, the WCDMA2100 characteristics are adjusted if the length of the second slot 8 and the location of the second grounding part 5 are adjusted.

Figure 5:
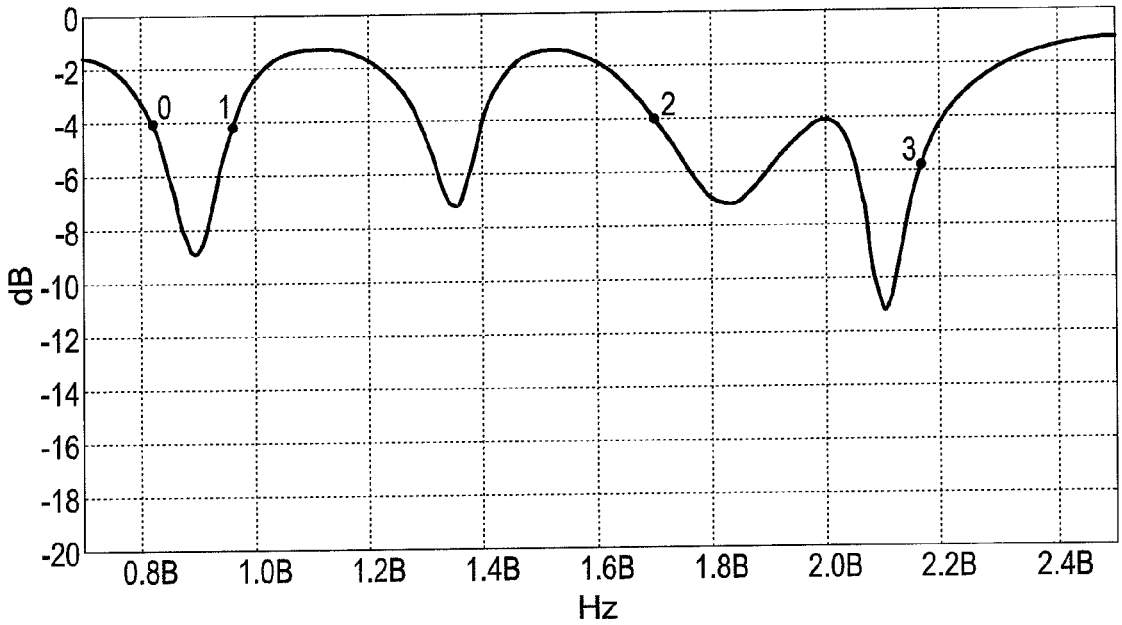
FIG. 5 shows a waveform diagram of the return loss of the antenna structure of the present invention.

FIG. 5 shows a waveform diagram of the return loss of the antenna structure of the present invention. The marker 0 indicates −4.17 dB at 824 MHz. The marker 1 indicates −4.34 dB at 960 MHz. The marker 2 indicates −4.30 dB at 1710 MHz. The marker 3 indicates −5.59 dB at 2170 MHz.

Figure 6:
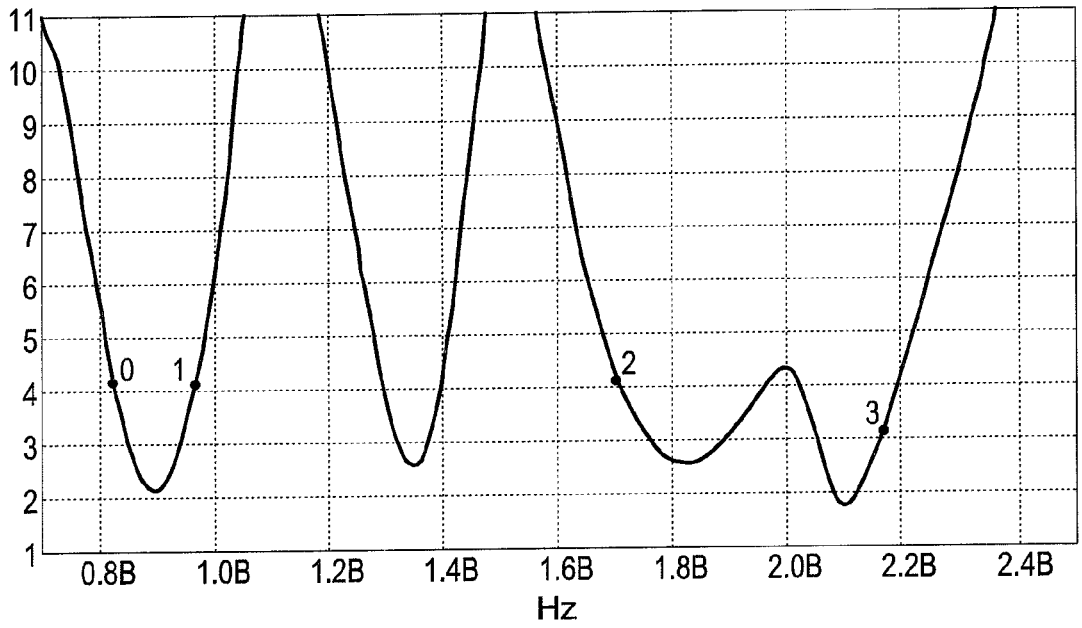
FIG. 6 shows a waveform diagram of the voltage standing wave ratio (VSWR) of the antenna structure of the present invention.

FIG. 6 shows a waveform diagram of the voltage standing wave ratio (VSWR) of the antenna structure of the present invention. The marker 0 indicates 4.25 at 824 MHz. The marker 1 indicates 4.08 at 960 MHz. The marker 2 indicates 4.16 at 1710 MHz. The marker 3 indicates 3.21 at 2170 MHz.

Moreover, the first grounding part 4 and the second grounding part 5 are independent single metal components. However, the first grounding part 4, the second grounding part 5, and the metal frame 6 could be designed integrally and be electrically connected to the circuit board 2 as well.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An antenna structure including:

a carrier body including a top side, a bottom side, a right side, and a left side, the right side connected to the top side and the bottom side, the left side connected to the top side and the bottom side;

a circuit board assembled with the carrier body;

a metal coupling sheet electrically connected to the circuit board and arranged at the bottom side of the carrier body;

a first grounding part connected to the left side of the carrier body and electrically connected to the circuit board;

a second grounding part connected to the left side of the carrier body and below the first grounding part and electrically connected to the circuit board; and a metal frame assembled with the carrier body and at the top side, the bottom side, the right side, and the left side, the metal frame electrically connected to the first grounding part and the second grounding part, wherein a first slot is between the metal frame and the right side; a second slot is between the metal frame, below the left side, and the bottom side; the metal coupling sheet, the first grounding part, and the first slot form a first communication path; the metal coupling sheet, the second grounding part, and the second slot form a second communication path.

2. The antenna structure in claim 1, wherein a signal feeding network and an RF circuit are on the circuit board; the signal feeding network and the RF circuit are configured to process and control signals.

3. The antenna structure in claim 2, wherein the metal coupling sheet includes a coupling part in arc shape and a signal feed-in part connected to the coupling part.

4. The antenna structure in claim 3, wherein the coupling part and the signal feed-in part form the metal coupling sheet in T-shape.

5. The antenna structure in claim 4, wherein a cross-section of the coupling part is in L-shape; the coupling part includes a long segment, a short segment, and an extension segment; the extension segment is connected to one side of the long segment and one side of the short segment.

6. The antenna structure in claim 5, wherein the long segment and the signal feed-in part are applied to the global system for mobile (GSM) communications.

7. The antenna structure in claim 6, wherein the short segment and the signal feed-in part are applied to the wideband code division multiple access (WCDMA) 2100.

8. The antenna structure in claim 7, wherein a distance is between the metal frame and the coupling part of the metal coupling sheet after the metal frame is assembled with the carrier body; a coupling distance between the metal coupling sheet and the metal frame are adjusted for changing an impedance of the antenna structure.

9. The antenna structure in claim 8, wherein the extension segment is perpendicular to the long segment and the short segment; the extension segment is configured to couple to the metal frame, so that a low-frequency bandwidth is increased.

10. The antenna structure in claim 9, wherein the metal coupling sheet is in L-shape if a length of the long segment is zero or a length of the short segment is zero.

11. The antenna structure in claim 10, wherein the first grounding part and the second grounding part are metal blocks or metal sheets.

12. The antenna structure in claim 11, wherein a width of the first slot is 2 to 3 mm.

13. The antenna structure in claim 12, wherein a width of the second slot is 2 to 3 mm.

14. The antenna structure in claim 13, wherein the first communication path forms a low-frequency resonance and a high-frequency resonance, so that the antenna structure is applied to a four bands GSM communications.

15. The antenna structure in claim 14, wherein a length of the first communication path is a wavelength of the GSM communications.

16. The antenna structure in claim 15, wherein the second communication path and the second grounding part form the WCDMA 2100 resonance, so that the antenna structure is applied to a five bands GSM and WCDMA communications.

17. The antenna structure in claim 16, wherein a length of the second communication path is one-fourth wavelength of the WCDMA 2100.

* * * * *